US005939665A

United States Patent [19]

Banyopadhyay

[11] Patent Number: 5,939,665

[45] Date of Patent: Aug. 17, 1999

[54] BRISK MANEUVERING DEVICE FOR UNDERSEA VEHICLES

[75] Inventor: Promode R. Banyopadhyay, Barrington, R.I.

[73] Assignee: The United States of America as represented by the Secretary of the Navy, Washington, D.C.

[21] Appl. No.: 08/605,243

[22] Filed: Feb. 12, 1996

[51] Int. Cl.[6] ..... F42B 19/00; F42B 10/00; B63G 8/14

[52] U.S. Cl. ..... 114/20.1; 114/20.2; 114/330; 244/3.24

[58] Field of Search ..... 114/20.1, 20.2, 114/21.1, 21.2, 23, 330, 332, 126; 244/3.21, 3.24, 3.25, 3.26, 3.27

[56] References Cited

U.S. PATENT DOCUMENTS

| | | | |
|---|---|---|---|
| 486,381 | 11/1892 | Lachmann | 114/126 |
| 1,125,567 | 1/1915 | Laurenti | 114/332 |
| 2,835,199 | 5/1958 | Stanly | 244/3.25 |
| 3,093,105 | 6/1963 | Rebikoff | 114/332 |
| 3,101,066 | 8/1963 | Haselton | 114/330 |
| 3,205,846 | 9/1965 | Lang | 114/20.1 |
| 3,752,103 | 8/1973 | Middleton | 114/332 |
| 4,364,531 | 12/1982 | Knoski | 244/3.27 |
| 4,586,680 | 5/1986 | DiTommaso et al. | 244/3.27 |
| 5,121,702 | 6/1992 | Johnson et al. | 114/332 |
| 5,211,358 | 5/1993 | Bagley | 244/3.27 |
| 5,237,952 | 8/1993 | Rowe | 114/332 |
| 5,487,351 | 1/1996 | Nedderman, Jr. | 114/332 |
| 5,549,065 | 8/1996 | Cipolla et al. | 114/23 |
| 5,551,365 | 9/1996 | Cipolla et al. | 114/23 |
| 5,615,632 | 4/1997 | Nedderman, Jr. | 114/330 |
| 5,673,645 | 10/1997 | Bandyopadhyay | 114/312 |

*Primary Examiner*—Charles T. Jordan
*Assistant Examiner*—Theresa M. Wesson
*Attorney, Agent, or Firm*—Michael J. McGowan; Prithvi C. Lall; Michael F. Oglo

[57] ABSTRACT

A nautical vehicle for traveling in a fluid environment, the nautical vehicle comprising a body having a dorsal fin mounted thereon. The body comprises a sidewall, a forward nose and a rear propulsor for propelling the vehicle in an axial direction. The dorsal fin is mounted on the sidewall, and includes a dorsal fin surface and camber generating element for generating a camber to provide a sideways thrust on said body to facilitate brisk maneuvering of the vehicle in the fluid environment.

8 Claims, 2 Drawing Sheets

BRISK MANEUVERING DEVICE FOR UNDERSEA VEHICLES

STATEMENT OF GOVERNMENT INTEREST

The invention described herein may be manufactured by or for the Government of the United States of America for Governmental purposes without the payment of any royalties thereon or therefor.

BACKGROUND OF THE INVENTION (1) Field of the Invention

The invention relates generally to the field of nautical vehicles and more particularly to arrangements for use in connection with nautical vehicles which provide for brisk maneuvering of such vehicles.

(2) Description of the Prior Art

In a number of areas, it is desirable to provide a brisk ("rapid") maneuvering capability for nautical vehicles, such as small, manned or unmanned undersea vehicles, torpedoes and the like, moving below the surface in a fluid environment. Brisk maneuvering may be used, for example, as a defense mechanism, to enable a vehicle to avoid destruction in a combat situation, or to steer a vehicle away from an unexpected obstruction. Brisk maneuvering can enable the vehicle to rapidly turn with a relatively small turning radius, and with relatively low noise. A brisk maneuvering device can also be used for so called "station keeping" of small unmanned underwater vehicles buffeted with streams in various directions.

SUMMARY OF THE INVENTION

It is therefore an object of the invention to provide a new and improved brisk maneuvering arrangement for use in connection with a nautical vehicle.

In brief summary, the invention provides a nautical vehicle for traveling in a fluid environment, the nautical vehicle comprising a body having a dorsal fin mounted thereon. The body comprises a sidewall, a forward nose and a rear propulsor for propelling the vehicle in an axial direction. The dorsal fin is mounted on the sidewall, and includes a dorsal fin surface and camber generating element for generating a camber to provide a sideways thrust on said body to facilitate brisk maneuvering of the vehicle in the fluid environment.

BRIEF DESCRIPTION OF THE DRAWINGS

This invention is pointed out with particularity in the appended claims. The above and further advantages of this invention may be better understood by referring to the following description taken in conjunction with the accompanying drawings, in which:

DESCRIPTION OF THE PREFERRED EMBODIMENT

Figure 2:
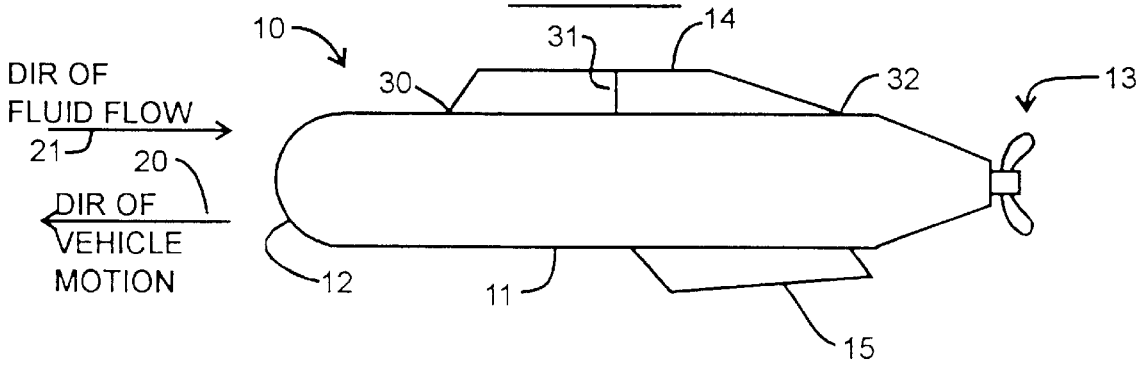
FIG. 2 is a side view of the vehicle depicted in FIG. 1.
Figure 3:
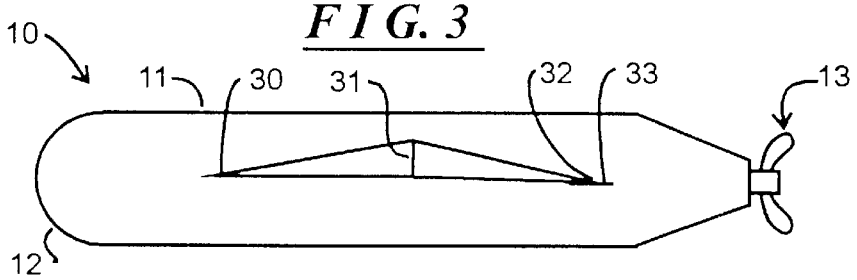
FIG. 3 is a top view of the vehicle depicted in FIG. 1.
Figure 1:
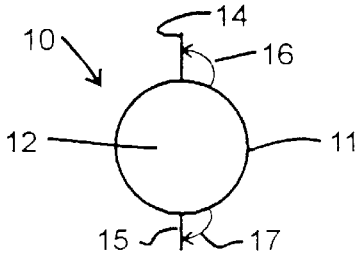
FIG. 1 is an end view of a nautical vehicle including a brisk maneuvering arrangement in accordance with the invention.

FIGS. 1 through 3 are respectively end, side and top views of a nautical vehicle 10 including a brisk maneuvering arrangement in accordance with the invention. With reference to FIGS. 1 through 3, nautical vehicle 10 includes a generally cylindrical sidewall 11 having a blunt forward nose 12 and a rear propulsor 13 such as a propeller and an upper dorsal fin 14 which provides for brisk maneuvering in accordance with the invention. In addition, the vehicle 10 may include an anal fin 15. The propulsor 13 will normally propel the vehicle 10 through a fluid environment in an axial direction that is represented by an arrow 20 as shown in FIG. 2, which iN turn results in a relative flow of the fluid over the vehicle in a direction represented by arrow 21.

The vehicle's dorsal fin 14 may be used to facilitate the brisk, relatively low-noise maneuvering of the vehicle 10 in an emergency situation, in particular in assisting the vehicle to turn or otherwise diverting its direction of travel from the forward direction. The dorsal fin 14 may normally be positioned in a retracted position which is flush with the cylindrical surface of the sidewall 11, and may be lifted into a deployed position as represented by the arrow 16 depicted in FIG. 1. In addition, the anal fin 15, if present, may be positioned flush with the cylindrical surface of sidewall 11, along the lower portion of the vehicle 10, and lifted into a deployed position as represented by the arrow 17.

Figure 4:
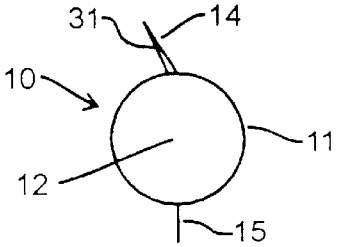
FIG. 4 is another end view of the nautical vehicle depicted in FIG. 1, useful in understanding the invention.

To facilitate the brisk, relatively low-noise maneuvering of the vehicle 10 in an emergency situation, the dorsal fin 14 is given a camber that interacts with the fluid environment to generate a side thrust which assists the vehicle 10 to turn or otherwise diverting its direction of travel from the forward direction. To accomplish the camber, the dorsal fin 14 is supported by hinges at several positions along its length (that is, in three positions along the length of the vehicle 10), in particular at its forward point 30, at its rear point 32, and at an arm 31 positioned intermediate therebetween. The arm 31 extends generally outwardly from the vehicle's sidewall 11, and is attached to the dorsal fin 14 along its length. The arm 31 may pivot in a plane generally transverse to the axis of vehicle 10 (as shown in FIGS. 3 and 4), and therefore transverse to the direction of travel when the vehicle 10 is traveling in a forward direction. The rear point 32 is mounted in a slot 33 (shown in FIG. 3), which is generally parallel to the axis of the vehicle 10, and therefore parallel to the direction of travel when the vehicle 10 is traveling in a forward direction. Preferably, the dorsal fin 14 will be constructed of a relatively stiff but flexible material, or a material such as fiberglass, rubber or cloth or synthetic material with similar flexibility characteristics, so that the fin 14 may be retracted, deployed, and provided with the camber necessary to provide the sideways thrusts as described herein. It should be noted that if the material of dorsal fin 14 is reasonably stiff like fiber glass, cambering by sliding arm 31 will result in a circular arc (FIG. 3) rather than a triangle as shown in FIG. 3.

The dorsal fin 14 is provided with a camber, to provide the vehicle with a sideways thrust to assist in maneuvering, by suitable manipulation of the arm 31 (as shown in FIGS. 3 and 4) and rear hinge 32 in slot 33. In particular, by moving the arm 31 in one direction relative to the direction of travel, and moving the rear hinge 32 forwardly in slot 33, a sideways thrust is provided in the opposite direction. Accordingly, when the direction of travel of vehicle 10 is to be diverted toward, for example, the right, the arm 31 will be moved to the right thereby to provide a sideways thrust in a rightward direction. On the other hand, when the direction of travel is to be diverted to the left, the arm 31 will be moved to the left thereby to provide a sideways thrust in a leftward direction.

It will be appreciated that the amount of sideways thrust which the dorsal fin 14 will preferably provide will generally be related to the radius of the vehicle's turn, so that, for larger turning radii small amounts of sideways thrust will suffice but for smaller radii it is preferable to provide larger amounts of sideways thrust. In addition, the amount of sideways thrust provided by the dorsal fin 14 is directly related to the amount which the arm 31 pivots from the normal (that is, from a direction orthogonal to the surface of sidewall 11, as shown in FIGS. 3 and 4), so that for a pivot of a relatively small angle a relatively small amount of sideways thrust will be generated by the dorsal fin 14, but for a pivot of a larger angle a larger amount of sideways thrust will be provided. Accordingly, it will be appreciated that, when it is desired to turn the vehicle 10 with a relatively large radius, it may suffice to pivot arm 31 only a small degree from the normal, but for turns of smaller radius it may be preferably to pivot arm 31 a larger extent to provide a greater sideways thrust. The thrust due to the cambered fin is generally proportional to the area of the fin and the speed of the vehicle (more particularly, roughly the square of the vehicle's speed).

The camber provided for dorsal fin 14 will also provide another benefit, namely, shedding of large scale vortices which may otherwise form proximate the vehicle 10 when its direction of travel deviates from the forward direction, which may increase drag on movement of vehicle 10, and may also generate noise proximate the vehicle 10. By providing a cambered surface for dorsal fin 14, the vortices are displaced further from the sidewall of the vehicle 10 and are reduced in size, both of which will reduce potential drag forces created thereby on the vehicle. In addition, reduction in vortex size will result in a reduction in noise. Because the trailing edge of the cambered fin 14 is at an angle to the axis of the vehicle's cylindrical sidewall 11, the wake of the vortex generated by the fin will spiral around the tail cone of the vehicle 10. This will help stabilize the brisk maneuvering motion which is another advantage of the cambered dorsal fin 14.

While the invention has been described in connection with a dorsal fin 14 mounted exteriorly of the sidewall 11 of vehicle 10, it will be appreciated that other means may instead be provided to generate a sideways thrust for assisting in brisk maneuvering in a generally similar manner. For example, sideways thrusts may be generated by injection of fluid outwardly along a direction similar to the contour of the fin 14. In such an operation, a number of perforations may be provided at various radial positions along the sidewall 11, through which fluid may be selectively injected. Alternatively, magnetohydrodynamic forces may be generated in connection with the surrounding fluid environment to generate the sideways thrusts.

Figure 5B:
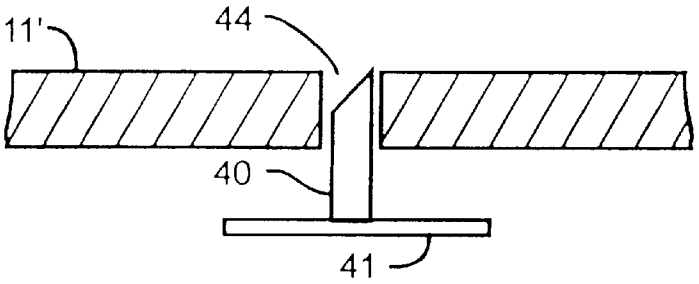
FIGS. 5B and 5C are sectional views helpful in understanding the operation of the embodiment depicted in FIG. 5A.
Figure 5C:
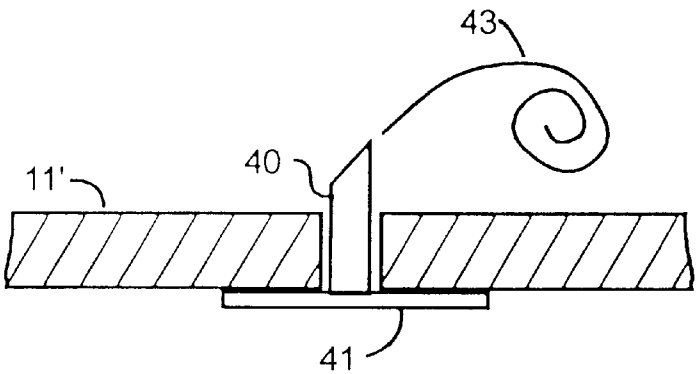
Figure 5A:
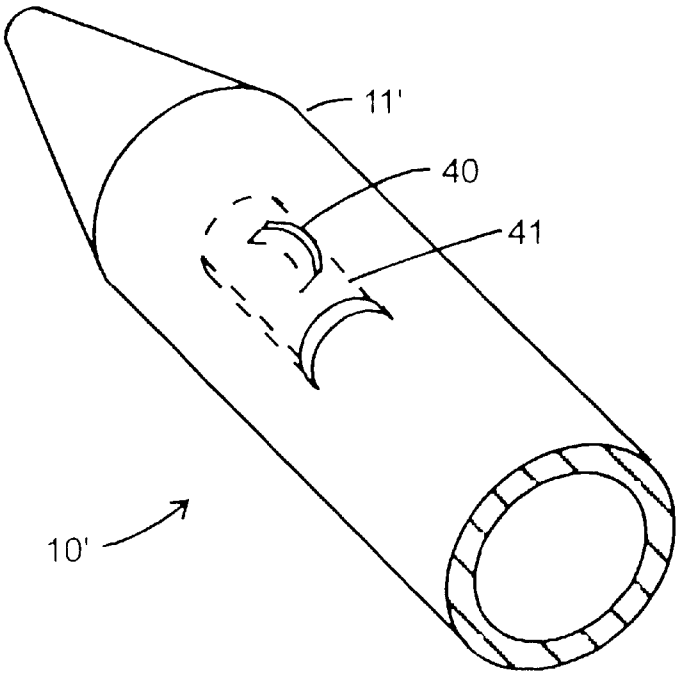
FIG. 5A depicts a plan view of a nautical vehicle including a second embodiment of a brisk maneuvering arrangement in accordance with the invention.

In another alternative, which will be described in connection with FIGS. 5A through 5C, instead of using a fin 14 described above in connection with FIGS. 1 through 4, a finlet 40 is provided which has a much smaller height than that of fin 14. FIG. 5A depicts a plan view of the vehicle 10', and FIGS. 5B and 5C depict a portion of a cross section of vehicle 10' taken along a plane generally perpendicular to the axis of the cylindrical sidewall, showing a detail of the sidewall 11' proximate the finlet 40. The finlet may be mounted on an interior wall 41 which generally conforms to the interior surface of sidewall 11'. When a brisk maneuvering operation is not required, the interior wall 41 may maintain finlet 40 in a retracted position in a slot 44 (FIGS. 5B and 5C). When a brisk maneuvering operation is required, the interior wall 41 may deploy the finlet 40 by moving it out radially through the slot 44(reference FIG. 5C). At that time a vortex, identified by reference numeral 43, will be formed by separating and rolling up the spanwise vorticity in the boundary layer proximate the sidewall 11 into a well-defined vortex 43. With the finlet 40 (FIGS. 1 through 4), the flow over the finlet 40 is generally laminar, and the fin's camber provides the required sideways thrust, and with the finlet 40 (FIGS. 5A through 5C) the vortex 43 provides the required sideways thrust. One advantage of the finlet 40 over the fin 14 is that the finlet 40 occupies much less radial space than that for fin 14. Also, the amount of sideways thrust provided by the finlet 40 may be adjusted by adjusting the distance by which the finlet 40 extends into the boundary layer, whereas sideways thrust provided by fin 14 is determined by the amount of camber of the fin 14.

The preceding description has been limited to specific embodiments of this invention. It will be apparent, however, that variations and modifications may be made to the invention, with the attainment of some or all of the advantages of the invention. Therefore, it is the object of the appended claims to cover all such variations and modifications as come within the true spirit and scope of the invention.

What is claimed is:

1. A nautical vehicle for traveling in a fluid environment, the nautical vehicle comprising:

a generally cylindrical body comprising a sidewall, a forward nose and a rear propulsor for propelling the vehicle in an axial direction;

a dorsal fin mounted on the sidewall of said body, the dorsal fin including a dorsal fin surface supported by attachment means at a plurality of positions along the length of said body and camber generating means for generating a camber to provide a sideways thrust on said body to facilitate brisk maneuvering of the vehicle in the fluid environment; and a finlet mounted on sidewall of said body to produce a sideways thrust on said body wherein said finlet has a height smaller than that of said dorsal fin.

2. A nautical vehicle as defined in claim 1 in which:

the dorsal fin includes the dorsal fin surface oriented generally orthogonal to the sidewall of said body along the vehicle axis and supported at forward and rearward end points of said body; and the camber generating means including forward and rear attachment means for facilitating attachment of the dorsal fin surface generally along an axis parallel to the vehicle axis, and arm means attached to the dorsal fin surface intermediate said plurality of attachment means to selectively pivot the dorsal fin surface in a direction generally transverse to the vehicle axis so as to provide camber in the dorsal fin surface.

3. A nautical vehicle as defined in claim 2 in which wherein said plurality of attachment means comprise hinge means.

4. A nautical vehicle as defined in claim 3 in which the sidewall of said body includes a slot proximate the rear hinge means, the rear hinge means moving inside the slot.

5. A nautical vehicle as defined in claim 2 in which the dorsal fin surface comprises a relatively stiff flexible material.

6. A nautical vehicle as defined in claim 1 in which the camber generating means generates a camber which is directly related to a desired sideways thrust.

7. A nautical vehicle for traveling in a fluid environment, the nautical vehicle comprising:

a generally cylindrical body including a sidewall, a forward nose and a rear propulsor means for propelling said body in a longitudinal direction;

slot means on said sidewall of said body;

an interior wall inside said sidewall of said body having a configuration matching that of said side wall of said body; and a finlet attached to said inner wall so as to retract said finlet in and out of said slot means on said sidewall of said body thereby generating a vortex when said finlet is pushed out of said slot means on said side wall and providing additional sideways thrusts on said sidewall of said body wherein said finlet has a height smaller than that of a dorsal fin on said inner wall of said body.

8. The nautical vehicle of claim 7 wherein said sideways thrusts move said nautical vehicle away from its axial motion.

* * * * *